US009833821B2

(12) United States Patent
Cho et al.

(10) Patent No.: US 9,833,821 B2
(45) Date of Patent: Dec. 5, 2017

(54) ROLL FORMING DEVICE FOR FORMING VARIABLE THICKNESS PLATE

(71) Applicant: SUNGWOO HITECH CO., LTD., Busan (KR)

(72) Inventors: Kuk-Rae Cho, Busan (KR); Mun Yong Lee, Busan (KR)

(73) Assignee: SUNGWOO HITECH CO., LTD., Busan (KR)

( * ) Notice: Subject to any disclaimer, the term of this patent is extended or adjusted under 35 U.S.C. 154(b) by 0 days.

(21) Appl. No.: 15/131,182

(22) Filed: Apr. 18, 2016

(65) Prior Publication Data

US 2017/0182536 A1 Jun. 29, 2017

(30) Foreign Application Priority Data

Dec. 29, 2015 (KR) ..... 10-2015-0188971

(51) Int. Cl.
*B21B 31/24* (2006.01)
*B21B 38/10* (2006.01)

(52) U.S. Cl.
CPC ..... *B21B 31/24* (2013.01); *B21B 38/105* (2013.01); *B21B 2271/06* (2013.01)

(58) Field of Classification Search
CPC ..... B21B 31/20; B21B 31/22; B21B 31/24; B21B 2271/02; B21B 2271/06; B21B 38/105
See application file for complete search history.

(56) References Cited

U.S. PATENT DOCUMENTS 3,587,278 A * 6/1971 Kracht ..... B21B 31/04 72/237

FOREIGN PATENT DOCUMENTS

| | | |
|---|---|---|
| JP | 11-077169 | 3/1999 |
| KR | 10-1996-0011979 | 9/1996 |
| KR | 10-2010-0078724 | 7/2010 |

* cited by examiner

*Primary Examiner* — Debra Sullivan
(74) *Attorney, Agent, or Firm* — Lex IP Meister, PLLC

(57) ABSTRACT

A roll forming device for forming a variable thickness plate is disclosed. A roll forming device for forming a variable thickness plate according to one or a plurality of exemplary embodiments may include both-side stand frames that are disposed at a left side and a right side on a process base at a predetermined distance from each other and in which a sliding groove is formed at a center portion in an up and down direction, a lower forming roll unit in which a lower forming roll is fixed on a lower rotation shaft such that both end portions are rotatably disposed on a lower sliding block that is fixed to a lower portion of each sliding groove on the both-side stand frames, an upper forming roll unit in which an upper forming roll is fixed on an upper rotation shaft such that both end portions are rotatably disposed at an upper sliding block that is disposed on each sliding groove of the both-side stand frames to be slidably moved in an up and down direction at an upper portion of the lower forming roll unit, a forming roll gap adjustment unit that adjusts an initial gap between the lower forming roll and the upper forming roll, wherein a worm wheel and a worm gear are operated in an adjustment block of each upper portion of the both-side stand frames and an adjustment screw that is screw-engaged to a center of the worm wheel in an up and down direction adjusts an up-down direction position of the both-side upper sliding blocks, and a spring unit that is disposed between the adjustment screw and the upper sliding block within each sliding groove of the both-side stand frames, absorbs a forming reaction force that is applied to the upper forming roll according to a thickness variation of a plate that is to be formed, and simultaneously maintains a forming pressure of the upper forming roll within a predetermined range.

5 Claims, 5 Drawing Sheets

PRIOR ART

ROLL FORMING DEVICE FOR FORMING VARIABLE THICKNESS PLATE

CROSS-REFERENCE TO RELATED APPLICATION

This application claims priority to and the benefit of Korean Patent Application No. 10-2015-0188971 filed in the Korean Intellectual Property Office on Dec. 29, 2015, the entire contents of which are incorporated herein by reference.

BACKGROUND OF THE INVENTION (a) Field of the Invention

The present invention relates to a roll forming device for forming a variable thickness plate. More particularly, the present invention relates to a roll forming device for forming a variable thickness plate in which an initial gap between an upper forming roll and a lower forming roll, which are disposed on a forming device, is set, and a spring unit absorbs a forming reaction force that is applied to the upper forming roll depending on a material thickness to be able to control a gap between the upper forming roll and the lower forming roll in real time.

(b) Description of the Related Art

Generally, forming of a line-type beam is performed by a roll forming system in which at least ten roll forming devices having an upper forming roll and a lower forming roll are disposed in line to bend and form supplied material into various shapes.

FIG. 1 shows a roll forming device of a general roll forming system and processes for each step.

Referring to FIG. 1, the roll forming system and process include an uncoiling step S110 in which an un-coiler 201 unfolding a supplied coil 200 is disposed at a front side of a process line, and a straightening step S120 in which a straightener 203 straightening a band-type coil 200 unrolled from the un-coiler 201 to a flat steel plate 250 is disposed at a rear side thereof.

Further, a brake press 205 is disposed at a rear side of the straightener 203 and performs a piercing step S130 to form various holes that are used to assemble a beam that is to be formed.

At least ten roll forming devices (207: R1-R7; partially not shown) are disposed at a rear side of the brake press 205 perform a roll forming step S140, which sequentially bends the steel plate 250 supplied through the un-coiler 201, the straightener 203, and the brake press 205, to a beam having a desired shape.

A round bender 209 that has a plurality of curvature forming rolls, which are disposed along a radius of a curvature for forming a curvature of a roll forming product, is disposed at a rear side of the roll forming device 207, and fabricates a predetermined curvature to perform a bending step S150.

However, in the conventional roll forming system, upper and lower forming rolls are is disposed at each roll forming device (R1-R7), and when a material is inserted, a gap deviation is formed between the upper forming roll and the lower forming roll by a forming reaction force, or particularly, in a case that a thickness of the material such as a TWB (Tailor Weld Blank) or a TRB (Tailor Rolled Blank) is changed, there is a drawback that a forming pressure exceeds a predetermined range by a predetermined gap between the upper forming roll and the lower forming roll.

Particularly, it is difficult to control a gap between an upper forming roll and a lower forming roll when plates (TWB, TRB, and so on) having different thicknesses in a length direction are inserted in real time, because it is difficult to accurately control a gap by using a servo motor in real time, so left and right forming deviations are generated on the upper forming roll and the lower forming roll, and thus there is a problem that a defective product is formed by a distortion that is caused by a forming pressure difference.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roll forming device for forming a variable thickness plate having advantages of controlling a gap between an upper forming roll and a lower forming roll in real time, wherein an initial gap is set between the upper forming roll and the lower forming roll that are disposed on each roll forming device of a roll forming system, and a spring unit absorbs a forming reaction force that is applied to the upper forming roll according to a material thickness.

A roll forming device for forming a variable thickness plate according to one or a plurality of exemplary embodiments may include both-side stand frames that are disposed at a left side and a right side on a process base at a predetermined distance from each other and in which a sliding groove is formed at a center portion in an up and down direction, a lower forming roll unit in which a lower forming roll is fixed on a lower rotation shaft such that both end portions are rotatably disposed on a lower sliding block that is fixed to a lower portion of each sliding groove on the both-side stand frames, an upper forming roll unit in which an upper forming roll is fixed on an upper rotation shaft such that both end portions are rotatably disposed at an upper sliding block that is disposed on each sliding groove of the both-side stand frames to be slidably moved in an up and down direction at an upper portion of the lower forming roll unit, a forming roll gap adjustment unit that adjusts an initial gap between the lower forming roll and the upper forming roll, wherein a worm wheel and a worm gear are operated in an adjustment block of each upper portion of the both-side stand frames and an adjustment screw that is screw-engaged to a center of the worm wheel in an up and down direction adjusts an up-down direction position of the both-side upper sliding blocks, and a spring unit that is disposed between the adjustment screw and the upper sliding block within each sliding groove of the both-side stand frames, absorbs a forming reaction force that is applied to the upper forming roll according to a thickness variation of a plate that is to be formed, and simultaneously maintains a forming pressure of the upper forming roll within a predetermined range.

A scale may be disposed at one side of the both-side stand frames respectively corresponding to the lower sliding block and the upper sliding block, and a scale needle may be disposed at one side of each of the lower sliding block and the upper sliding block corresponding to each scale.

A rib may be formed at one side of each of the both-side stand frames so as to reinforce stiffness.

The lower forming roll unit may include both-side lower sliding blocks that are fixed to a lower portion of each sliding groove on the both-side stand frames, a lower rotation shaft of which both end portions are rotatably disposed on the both-side lower sliding blocks through a bearing, and a lower forming roll that is disposed at a center of the lower rotation shaft through key engagement between the both-side stand frames through both-side collar rings and that rotates together with the lower rotation shaft.

The upper forming roll unit may include both-side upper sliding blocks that are disposed on each sliding groove of the both-side stand frames to be able to slide in an up and down direction at an upper portion of the both-side lower sliding blocks, an upper rotation shaft of which both end portions are rotatably disposed on the both-side upper sliding blocks through a bearing, and an upper forming roll that is key-engaged with a center of the upper rotation shaft between the both-side stand frames through the both-side collar rings and rotates together with an upper rotation shaft to form a predetermined gap with the lower forming roll.

The forming roll gap adjustment unit may include both-side adjustment blocks that are fixed to each upper portion of the both-side stand frames and in which a space portion is respectively formed, a worm wheel that is disposed in each space portion of the both-side adjustment blocks and is able to rotate through a bearing, a worm gear that is respectively fixed on an adjustment shaft penetrating the both-side adjustment blocks in a lateral direction and is engaged with the worm wheel in each space portion of the both-side adjustment blocks, and an adjustment screw that is screw-engaged with each worm wheel in the both-side adjustment blocks and of which a lower end thereof is connected to the spring unit through a rotation body.

Each upper side of the both-side adjustment blocks may be opened, and a cover may cover the opened portion.

The spring unit may include a support block that is fixed to an upper surface of the upper sliding block in each sliding groove of the both-side stand frames, a spring housing that is fixedly engaged with an upper portion of the support block, an upper surface of which is opened, and that forms a receiving space portion together with the support block, a retainer that is disposed at an upper portion at an inside of a receiving space portion of the spring housing, an upper end of which is connected to a lower end of the adjustment screw through a rotation body, and in which a spring guider is formed at a center of a lower surface thereof, and a plurality of disk springs that are disposed inside a receiving space portion of the spring housing to be engaged with a spring guider of the retainer in a crisscross manner and offers elastic force between the retainer and the support block.

The roll forming device may further include a space ring that is engaged with the spring guider between the support block and a disk spring to vary elastic force of an entire disk spring.

In an exemplary embodiment of the present invention, an initial gap is set between an upper forming roll and a lower forming roll that are disposed on each roll forming device of a roll forming system, a spring unit absorbs a forming reaction force that is applied to an upper forming roll depending on a material thickness, and a gap between an upper forming roll and a lower forming roll is accurately controlled in real time to prevent a gap deviation between a left and a right thereof according to a material thickness.

Accordingly, a forming pressure is uniformly maintained within a predetermined range and an up and down direction position of an upper forming roll is adjusted to enable a variable plate to be roll-formed, and thus a variation of roll forming can be optimized and a distortion generated by a variation of a forming pressure is prevented to improve an appearance quality.

DETAILED DESCRIPTION OF THE EMBODIMENTS

Figure 1:
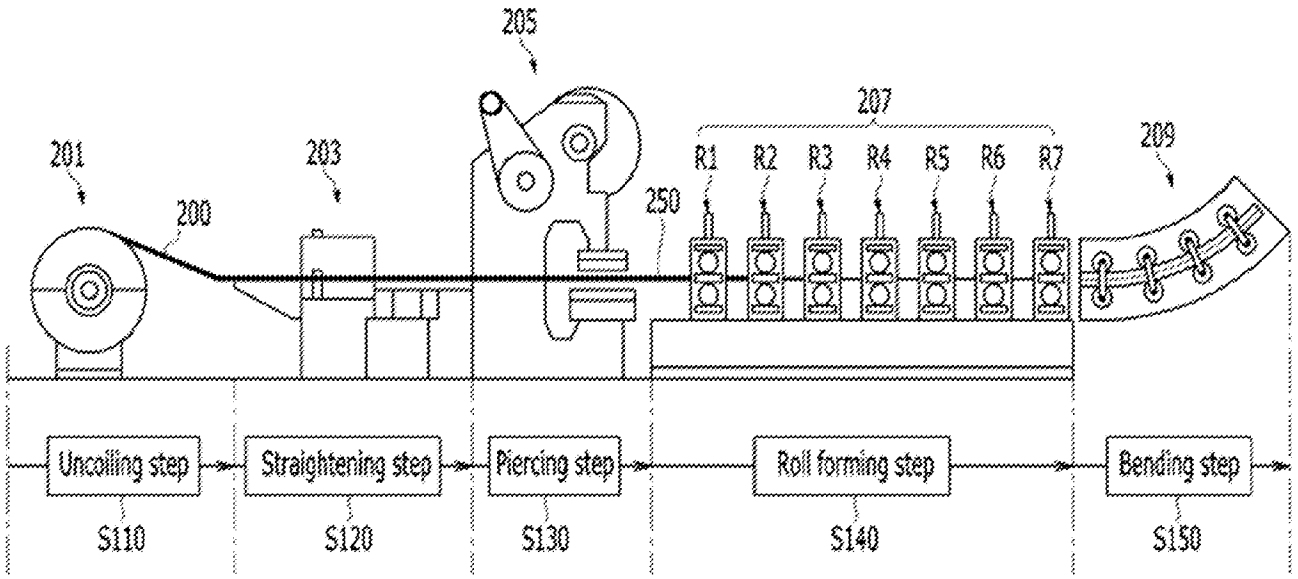
FIG. 1 shows a roll forming device of a general roll forming system and processes for each step.

Hereinafter, an exemplary embodiment of the present invention will be described in detail with reference to accompanying drawings.

The size and thickness of each component shown in the drawings are arbitrarily shown for better understanding and ease of description, but the present invention is not limited thereto, and the thickness of parts, regions, etc., are exaggerated for clarity.

Also, in order to clarify an exemplary embodiment of the present invention, parts that are not related to the description are omitted.

Figure 2:
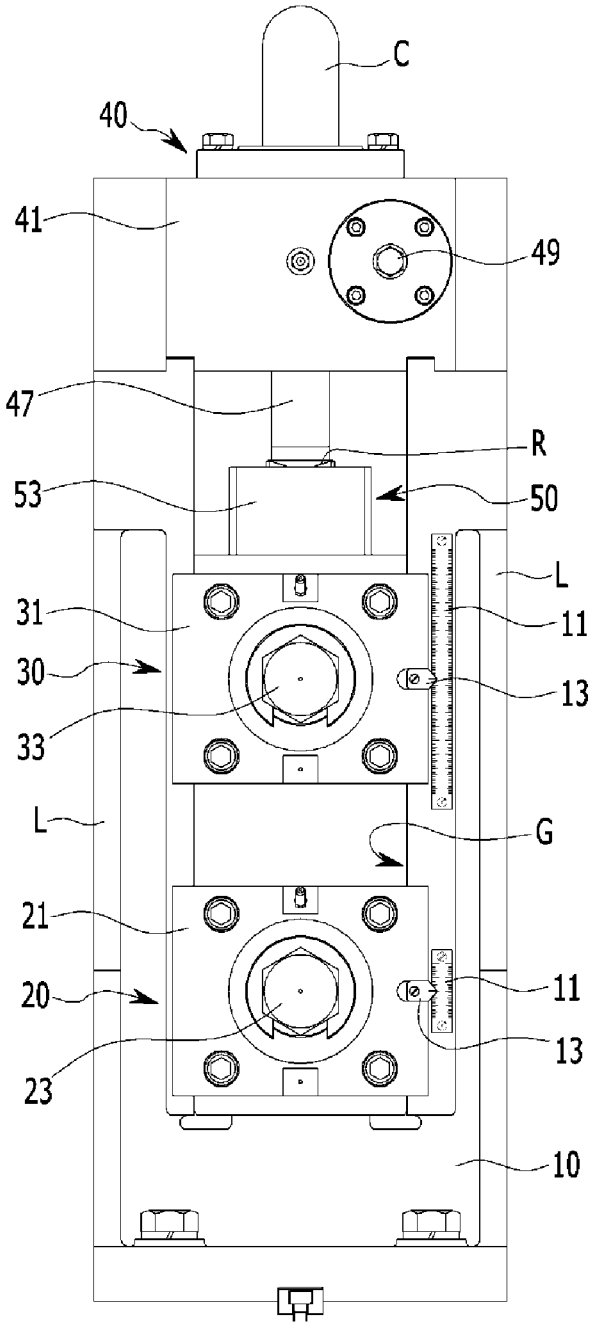
FIG. 2 is a front view of a roll forming device according to an exemplary embodiment of the present invention.
Figure 3:
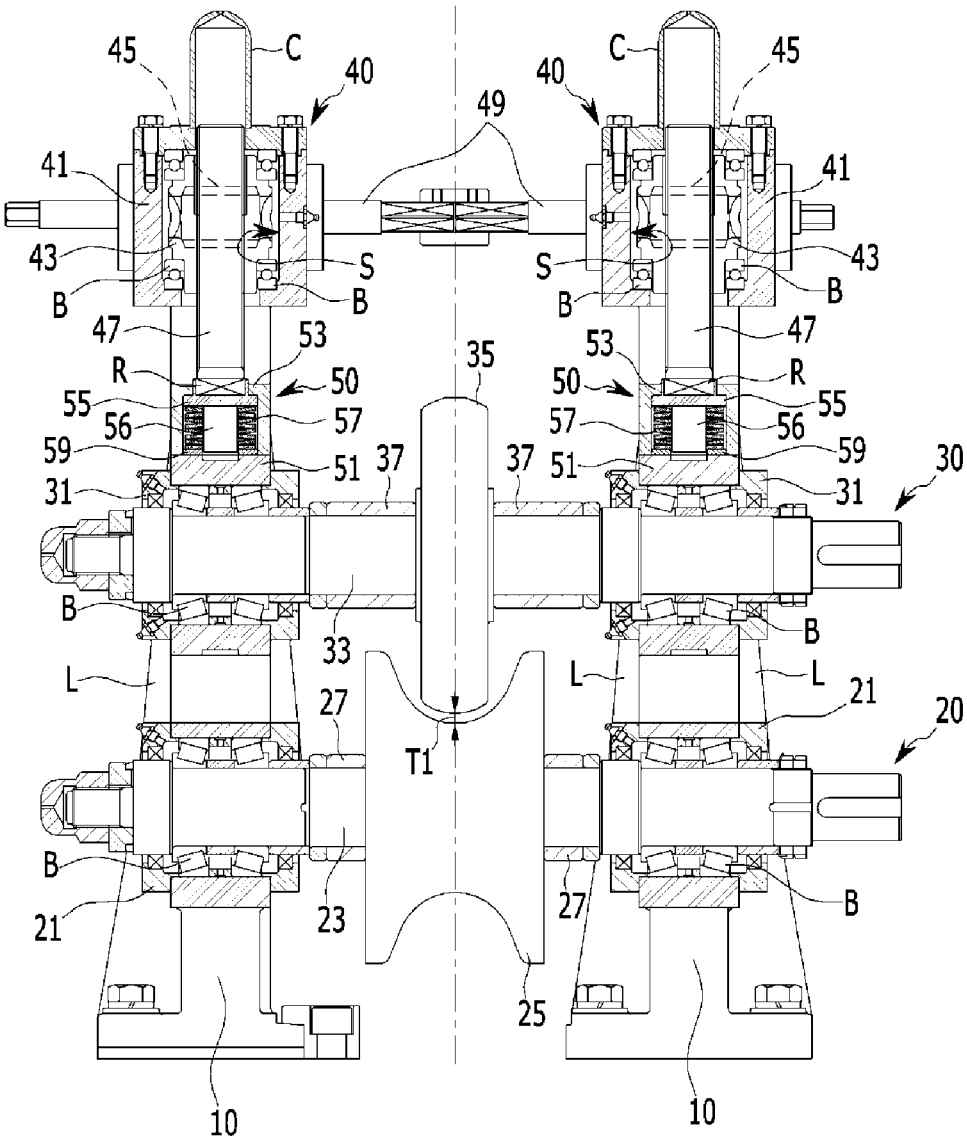
FIG. 3 is a cross-sectional side view of a roll forming device according to an exemplary embodiment of the present invention.

FIG. 2 is a front view of a roll forming device according to an exemplary embodiment of the present invention, and FIG. 3 is a cross-sectional side view of a roll forming device according to an exemplary embodiment of the present invention.

Referring to FIG. 2 and FIG. 3, a roll forming device according to an exemplary embodiment of the present invention includes both-side stand frames 10, a lower forming roll unit 20, an upper forming roll unit 30, a forming roll gap adjustment unit 40, and a spring unit 50.

Firstly, the both-side stand frames 10 are disposed at a left side and a right side on a process base (not shown) at a predetermine distance from each other, and a sliding groove (G) is formed at each center portion in the up-down direction.

A rib (L) is formed at both sides of each inner side and outer side of the both-side stand frames 10 so as to reinforce supporting stiffness.

In the lower forming roll unit 20, a lower sliding block 21 is respectively fixed at a lower portion of each sliding groove (G) on the both-side stand frames 10, both end portions of a lower rotation shaft 23 are rotatably disposed at both sides of the lower sliding block 21, and a lower forming roll 25 is fixed on the lower rotation shaft 23.

To describe the lower forming roll unit 20 in detail, respective sides of the lower sliding block 21 are fixed to lower portions of each sliding groove (G) on the both-side stand frames 10.

Both end portions of the lower rotation shaft 23 are rotatably disposed in both sides of the lower sliding block 21 through a bearing (B).

Also, the lower forming roll 25, which is disposed at a center of the lower rotation shaft 23 to be engaged by a key between the both-side stand frames 10 and between both-side collar rings 27 that are inserted into both sides of the lower rotation shaft 23, is configured to rotate together with the lower rotation shaft 23.

In this condition, the lower forming roll 25 is disposed on a center of the lower rotation shaft 23 to be supported by both side collar rings 27.

The upper forming roll unit 30 is disposed at an upper portion of the lower forming roll unit 20, respective sides of an upper sliding block 31 are disposed at each sliding groove (G) on the both-side stand frames 10 to be slidably moved in an up and down direction, both end portions of an upper rotation shaft 33 are rotatably disposed on both sides of the sliding block 31, and an upper forming roll 35 is fixed on the upper rotation shaft 33.

More specifically, for the upper forming roll unit 30, respective sides of the upper sliding block 31 are disposed at each sliding groove (G) on the both-side stand frames 10 to be slidably moved in an up and down direction above both sides of the lower sliding block 21.

Both end portions of the upper rotation shaft 33 are rotatably disposed inside both sides of the upper sliding block 31 through a bearing (B).

Also, the upper forming roll 35, which is disposed at a center of the upper rotation shaft 33 to be engaged by a key between both-side stand frames 10 and between both side collar rings 37 that are inserted into both sides of the upper rotation shaft 33, is configured to rotate together with the upper rotation shaft 33. In this condition, the upper forming roll 35 is disposed on a center of the upper rotation shaft 33 to be supported by both-side collar rings 37, and the upper forming roll 35 forms an initial gap (T1) with the lower forming roll 25.

Here, a scale 11 is disposed at on side of a stand frame 10 to be extended in an up and down direction corresponding to the lower sliding block 21 and the upper sliding block 31, and a scale needle 13 is disposed at one side of the lower sliding block 21 and the upper sliding block 31 corresponding to the scale 11.

The scale 11 and the scale needle 13 are used as a base for adjusting a position and gap of the lower forming roll 25 and the upper forming roll 35.

Further, in the forming roll gap adjustment unit 40, a worm wheel 43 and a worm gear 45, which are disposed inside an adjustment block 41 of each upper portion of the both-side stand frames 10, are operated, and an adjustment screw 47 that is screw-engaged with a center of the worm wheel 43 to be extended in an up and down direction adjusts a vertical position of both sides of the upper sliding block 31 to be able to adjust the initial gap T1 between the lower forming roll 25 and the upper forming roll 35.

In more detail, the both-side adjustment blocks 41 are fixed at each upper portion of the both-side stand frames 10, and a space portion (S) is formed in the forming roll gap adjustment unit 40.

Here, an upper portion of the both-side adjustment block 41 is opened, and a cover (C) is engaged with the opened portion to cover the space portion (S).

The worm wheel 43 is disposed in each space portion (S) of the both-side adjustment block 41 and is disposed in a lateral direction to rotate through a bearing (B).

Also, in a condition in which the worm gear 45 is engaged with the worm wheel 43 in each space portion (S) of the both-side adjustment block 41, the worm gear 45 is fixed on an adjustment shaft 49 to penetrate the both-side adjustment block 41 in a lateral direction.

Also, the adjustment screw 47 is screw-engaged with each worm wheel 43 to penetrate a center thereof in an up and down direction inside the both-side adjustment block 41, and a lower end of the adjustment screw 47 is connected to the spring unit 50 through a rotation body (R).

Figure 4:
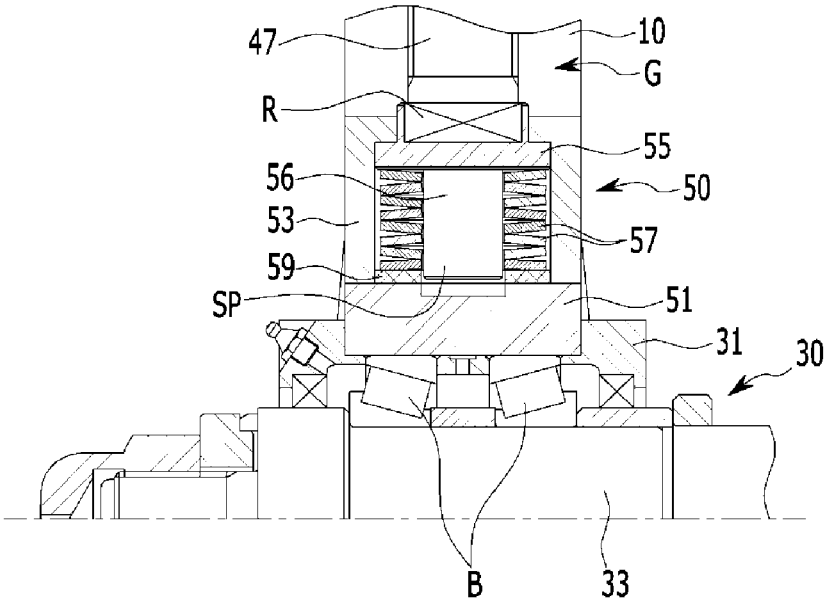
FIG. 4 is an enlarged cross-sectional view of a spring unit that is applied to a roll forming device according to an exemplary embodiment of the present invention.

FIG. 4 is an enlarged cross-sectional view of a spring unit that is applied to a roll forming device according to an exemplary embodiment of the present invention.

The spring unit 50 that is disposed inside each sliding groove (G) of the both-side stand frames 10 between the adjustment screw 47 and the upper sliding block 31 absorbs a forming reaction force that is applied to the upper forming roll 35, and simultaneously maintains a forming pressure of the upper forming roll 35 within a predetermined range in real time according to a thickness of a plate, wherein the thickness is different in a length direction.

Referring to FIG. 4, in more detail, the spring unit 50 includes a support block 51, a spring housing 53, a retainer 55, a disk spring 57, and a space ring 59.

The support block 51 is integrally fixed on an upper surface of the upper sliding block 31 inside each sliding groove (G) of the both-side stand frames 10.

The spring housing 53 is engaged with an upper portion of the support block 51, and an upper portion thereof is opened to form a receiving space portion (SP) together with the support block 51.

Also, the retainer 55 is disposed at an opened upper portion of the receiving space portion (SP) of the spring housing 53 to be supported in an upper direction. An upper end of the retainer 55 is connected to a lower end of the adjustment screw 47 through the rotation body (R), and a spring guider 56 is formed at a center of a lower surface thereof.

Also, a plurality of the disk springs 57 are disposed inside a receiving space portion (SP) of the spring housing 53, and are engaged with the spring guider 56 of the retainer 55 in a crisscross manner to offer elastic force between the retainer 55 and the support block 51.

The space ring 59 is disposed between the support block 51 and the disk spring 57, and the space ring 59 is engaged with the spring guider 56 to be able to adjust the number of disk springs 57 such that elastic force thereof can be varied.

Figure 5:
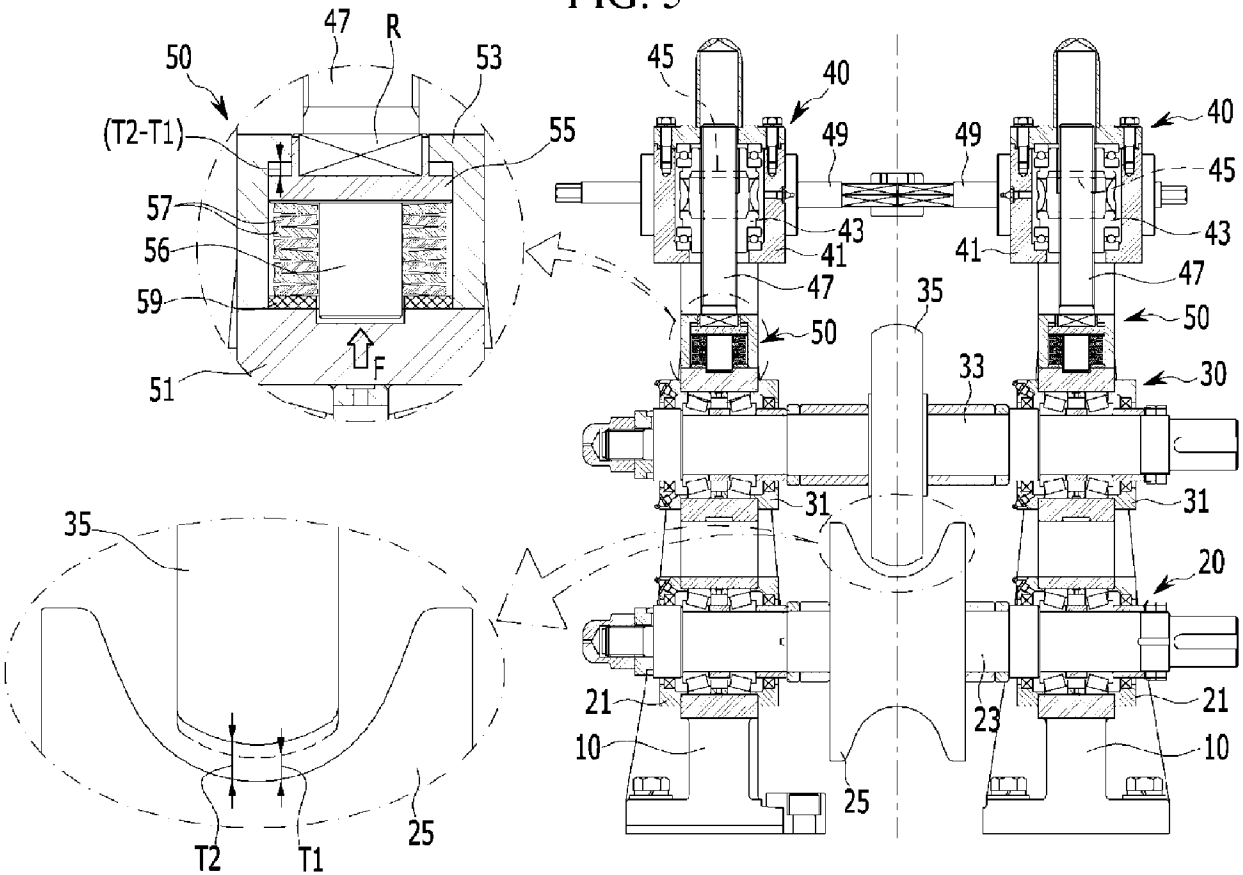
FIG. 5 is an operation state diagram of a roll forming device according to an exemplary embodiment of the present invention.

FIG. 5 is an operation state diagram of a roll forming device according to an exemplary embodiment of the present invention.

Hereinafter, referring to FIG. 3 and FIG. 5, an operation of a roll forming device for forming a variable thickness plate having the above configuration will be described.

Firstly, as shown in FIG. 3, an upper forming roll 35 and a lower forming roll 25 that are disposed at each roll forming device of a roll forming system sets an initial gap T1 by a forming roll gap adjustment unit 40.

That is, if an operator controls both side worm gears 45 through an adjustment shaft 49, both side worm wheels 43 engaged with both side worm gears 45 are rotated, each adjustment screw 47 that is engaged with a center of each worm wheel 43 moves upward or downward depending on a rotation direction of each worm wheel 43 to minutely move both side upper sliding blocks 31 of an upper forming roll unit 30, which is connected by each spring unit 50, in an up and down direction, and an up and down direction position of an upper forming roll 35 based on the lower forming roll 25 is varied to set an initial gap T1 between forming rolls.

In this condition, as shown in FIG. 5, a plate that has a variable thickness in a length direction, particularly, TWB, TRB, and so on, is inserted in a process direction, the plate is formed by an upper forming roll 35 and a lower forming roll 25, if a part where a thickness of a plate is thick is interposed between the upper forming roll 35 and the lower forming roll 25, a spring unit 50 absorbs a forming reaction force (F) depending on the thickness of the plate through the upper forming roll 35.

That is, an upper forming roll 35 compresses a plurality of disk springs 57 of a spring unit 50 depending on a thickness of a plate, and an initial gap T1 between a lower forming roll 25 and a upper forming roll 35 is adjusted to a fine adjustment gap T2 to absorb a forming reaction force (F) depending on a thickness of a plate.

In this condition, a forming reaction force (F) of an upper forming roll 35 is input into a support block 51 through an upper sliding block 31, and a support block 51 compresses a plurality of disk springs 57 that are disposed between a retainer 55 to be minutely moved upward by a varied thickness of the plate together with a spring housing 53 such that an upper forming roll unit 30 is minutely moved upward based on a lower forming roll unit 20 to absorb a forming reaction force (F).

Also, because elastic force of each disk spring 57 of the spring unit 57 is set to uniformly maintain a forming pressure of an upper forming roll 35 to a lower forming roll 25, there is no problem for forming a plate.

As described above, a roll forming device for forming a variable thickness plate according to an exemplary embodiment of the present invention uses a spring unit 50 to absorb a forming reaction force (F) according to a thickness variation of a plate, accurately controls an initial gap T1 to a fine adjustment gap T2 between an upper forming roll 35 and a lower forming roll 25 in real time, prevents a gap deviation of a left side and a right side depending on a thickness variation of a plate, and accordingly, a roll forming variation amount can be optimized and a distortion of a final formed beam can be prevented by maintaining a forming pressure, while a plate of which the thickness is different in a length direction is being roll-formed.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

DESCRIPTION OF SYMBOLS

10: stand frame
11: scale
13: scale needle
20: lower forming roll unit
21: lower sliding block
23: lower rotation shaft
25: lower forming roll
27: collar ring
30: upper forming roll unit
31: upper sliding block
33: upper rotation shaft
35: upper forming roll
37: collar ring
40: forming roll gap adjustment unit
41: adjustment block
43: worm wheel
45: worm gear
47: adjustment screw
49: adjustment shaft
50: spring unit
51: support block
53: spring housing
55: retainer
56: spring guider
57: disk spring
59: space ring
G: sliding groove
L: rib
B: bearing
T1: initial gap
T2: fine adjustment gap
S: space portion
SP: receiving space portion
C: cover
R: rotation body

What is claimed is:

1. A roll forming device for forming a variable thickness plate, comprising:

both-side stand frames that are disposed at a left side and a right side on a process base at a predetermined distance from each other and in which a sliding groove is formed at a center portion in an up and down direction;

a lower forming roll unit in which a lower forming roll is fixed on a lower rotation shaft such that both end portions are rotatably disposed on a lower sliding block that is fixed to a lower portion of each sliding groove on the both-side stand frames;

an upper forming roll unit in which an upper forming roll is fixed on an upper rotation shaft such that both end portions are rotatably disposed at an upper sliding block that is disposed on each sliding groove of the both-side stand frames to be slidably moved in an up and down direction above the lower forming roll unit;

a forming roll gap adjustment unit that adjusts an initial gap between the lower forming roll and the upper forming roll, wherein a worm wheel and a worm gear are operated in an adjustment block of each upper portion of the both-side stand frames and an adjustment screw that is screw-engaged to a center of the worm wheel in an up and down direction adjusts an up-down direction position of the both-side upper sliding blocks; and a spring unit that is disposed between the adjustment screw and the upper sliding block within each sliding groove of the both-side stand frames, absorbs a forming reaction force that is applied to the upper forming roll according to a thickness variation of a plate that is to be formed, and simultaneously maintains a forming pressure of the upper forming roll within a predetermined range, wherein the spring unit includes:

a support block that is fixed to an upper surface of the upper sliding block in each sliding groove of the both-side stand frames;

a spring housing that is fixedly engaged with an upper portion of the support block, an upper surface of which is opened, and that forms a receiving space portion together with the support block;

a retainer that is disposed at an upper portion at an inside of the receiving space portion of the spring housing, an upper end of which is connected to a lower end of the adjustment screw through a rotation body, and a spring guider is formed at a center of a lower surface thereof; and a plurality of disk springs that are disposed inside of the receiving space portion of the spring housing to be engaged with the spring guider of the retainer in a crisscross manner and offer elastic force between the retainer and the support block.

2. The roll forming device of claim 1, wherein a scale is disposed at one side of the both-side stand frames respectively corresponding to the lower sliding block and the upper sliding block, and a scale needle is disposed at one side of each of the lower sliding block and the upper sliding block corresponding to each scale.

3. The roll forming device of claim 1, wherein a rib is formed at one side of each of the both-side stand frames so as to reinforce stiffness.

4. The roll forming device of claim 1, wherein each upper side of the both-side adjustment blocks is opened and a cover covers the opened portion.

5. The roll forming device of claim 1, further comprising a space ring that is engaged with the spring guider between the support block and the plurality of disk springs to vary elastic force of an entire disk spring.

* * * * *